US006845867B2

(12) United States Patent
Sussegger et al.

(10) Patent No.: US 6,845,867 B2
(45) Date of Patent: Jan. 25, 2005

(54) CLASSIFIER FOR THE CLASSIFICATION OF GRANULAR MATERIAL

(75) Inventors: Albert Sussegger, Eitorf (DE); Alexander Hagedorn, Pulheim (DE); Immo Behrndt, Niederkassel (DE)

(73) Assignee: KHD Humboldt Wedag AG, Cologne (DE)

( * ) Notice: Subject to any disclaimer, the term of this patent is extended or adjusted under 35 U.S.C. 154(b) by 136 days.

(21) Appl. No.: 10/217,958

(22) Filed: Aug. 13, 2002

(65) Prior Publication Data

US 2003/0075486 A1 Apr. 24, 2003

(30) Foreign Application Priority Data

Aug. 29, 2001 (DE) ..... 101 42 162

(51) Int. Cl.[7] ..... B07B 4/00; B07B 7/00

(52) U.S. Cl. ..... 209/151; 209/135; 209/137; 209/139.1; 209/143

(58) Field of Search ..... 209/151, 154, 209/135, 137, 139.1, 142, 143

(56) References Cited

U.S. PATENT DOCUMENTS 1,655,575 A * 1/1928 Stebbins ..... 209/137
2,956,680 A * 10/1960 Puhr-Westerheide et al. .... 209/151
3,426,893 A * 2/1969 Stark ..... 209/3
4,618,415 A * 10/1986 Vecchio et al. ..... 209/134
4,840,727 A * 6/1989 Humphrey ..... 209/32
5,392,998 A * 2/1995 Suessegger et al. ..... 209/143
5,505,389 A * 4/1996 Sussegger et al. ..... 241/48
6,347,707 B1 * 2/2002 Sussegger et al. ..... 209/143
6,405,405 B1 * 6/2002 Hauch ..... 209/644

FOREIGN PATENT DOCUMENTS

DE 19648841 5/1998
DE 19648841 A1 * 5/1998 ..... B07B/4/04
EP 650763 12/1998

* cited by examiner

*Primary Examiner*—Donald P. Walsh
*Assistant Examiner*—Joseph C Rodriguez
(74) *Attorney, Agent, or Firm*—Charles L. Schwab; Nexsen Pruet

(57) ABSTRACT

A static V-classifier or cascade classifier having a stairway cascade (13) and oppositely arranged classifying flues (15) with upward extending and adjustable guide vanes (21) at their upper ends for altering the cut point of the classifier by controlling the classifying gas velocity in the several classifying ducts lying between the classifying flues (15).

42 Claims, 2 Drawing Sheets

CLASSIFIER FOR THE CLASSIFICATION OF GRANULAR MATERIAL

TECHNICAL FIELD

This invention relates to a classifier for the classification of granular material, having a housing approximately V-shaped in vertical section into one leg of which there is built a stairway cascade lying obliquely at an angle departing from the vertical, permeable for the classifying gas. The other leg of the V-shaped housing contains classifying flues lying one above another and obliquely downwardly inclined in louver fashion. A classifying zone lies between the stairway cascade and the classifying flues. An inlet opening for the classification feed is provided above the classifying zone at the top of the housing and a discharge opening for an oversize fraction is provided below the classifying zone on the bottom of the housing.

BACKGROUND OF THE INVENTION

Such a classifier, because it has no moving parts, is a purely static classifier, and it is known in principle. A static classifier incorporated into a closed milling circuit may be called a V-classifier or a cascade classifier because of its configuration as it appears in vertical section.

SUMMARY OF THE INVENTION

In the case of the V-classifier, the feed material for classification, which can be made up of press scales of a high-pressure roll mill for the performance of autogenous size reduction, falls by gravity in cascade fashion over a series of steps of a stairway cascade through which the classifying air flows. If press scales are present, these are deagglomerated in the process, and the classifying air flows first, in crossflow, removes the fines from the cascade curtain and transports it to the fines discharge via a row of obliquely upwardly ascending classifying ducts arranged roughly parallel to the stairway cascade. The classifying ducts are arranged between classifying flues lying one above another and obliquely downwardly inclined in louver fashion. In the several obliquely upwardly ascending classifying ducts, any splash material or oversize material admitted from the crossflow classifying zone slides back according to the principle of "gravity force against air flow drag force," and this oversize material, together with the oversize fraction proper, falls downwardly via the stairway cascade and leaves the classifier at the bottom via a discharge opening for oversize material.

A static cascade classifier should operate as an upward-current classifier in the classifying ducts between the classifying flues. It is, however, not always guaranteed that the fines classified out in the crossflow in the classifying zone are carried along upwardly and discharged by the classifying air flow through the ascending classifying ducts arranged between the classifying flues, because this requires a certain classifying air flow velocity that cannot always be attained in all classifying ducts. Also part of the fines may not have been separated from the oversize fraction and were discharged together with the oversize fraction. Because the separative efficiency of the known static V-classifiers or cascade classifiers was not yet optimized, it was earlier proposed to connect a further classifier (static or, dynamic) immediately after the cascade classifier, but this entails an expense for construction and an increase in the pressure drop.

It is an object of the invention to create a simply constructed static V-classifier or cascade classifier of the type cited at the outset, which is distinguished by a high separative efficiency with a comparatively low pressure drop and, as appropriate, also offers the possibility that the cut point of the classifier can be altered in simple fashion.

An improvement for the static V-classifier with stairway cascade and classifying flues according to the invention is that upwardly extending guide vanes are arranged at the upper end of the classifying flues that separate the obliquely upwardly running classifying ducts of the upward-current classifier portion of the classifier from one another, which guide vanes are adjustable for the control of the classifying gas velocity in the several classifying ducts lying between the classifying flues, and specifically are jointly or severally individually adjustable. In this way it is possible to influence the exit velocity of the classifying air from the classifying ducts and thus the reliable withdrawal of the classified-out fines from the classifier together with the classifying gas. At the same time, the classifying gas velocity in the several classifying ducts can be equalized through control action on the several adjustable guide vanes. In any case, the static classifier according to the invention is capable of a high separative efficiency that does not have to be purchased at the cost of a high classifier pressure drop.

The adjustable guide vanes can be pivotably articulated on the tops of the classifying flues. The guide vanes can, however, also be rotatably and/or slidably arranged elsewhere in the classifying housing in order that the flow velocity of the fines-laden classifying gas can be increased, for example by constriction of the outlet cross section for the classifying gas at the outlet from the classifying ducts formed between the classifying flues.

According to a further feature of the invention, the classifier housing can be provided with inlet openings in the downstream region after the classifying flues and guide vanes for the introduction of secondary air, which then serves as lifting air for the reliable lifting of the fines fraction upwardly out of the outlet opening for the fines fraction. Further, according to a feature of the invention, the classifier housing can have, somewhat above the discharge opening for the oversize fraction, an inlet opening for purge air for reclassifying the oversize fraction and aiding the transport of the fines fraction out of the classifier. All these practices contribute to increasing the separative efficiency of the static classifier according to the invention.

According to a further feature of the invention, at least one lateral wall of the classifier housing, which is arranged in the downstream region after the classifying flues and guide vanes, for example the rear end wall at the fines discharge of the classifier housing, can be arranged pivotably. In order that various fineness requirements can be met, for example in the case where a very fine cut point is desired, this end wall is then pivoted inward and, by virtue of the associated lower throughput of classifying gas, the flow velocity is adjustable to the minimum value required for the withdrawal of the fines fraction. The classifier according to the invention is therefore not only distinguished by a high separative efficiency, but it also offers the possibility of altering the cut point of the classifier in simple fashion.

BRIEF DESCRIPTION OF THE DRAWINGS

The invention and its further features and advantages are explained in more depth on the basis of the exemplary embodiment illustrated schematically in the drawings, in which.

DETAILED DESCRIPTION OF THE INVENTION

Figure 1:
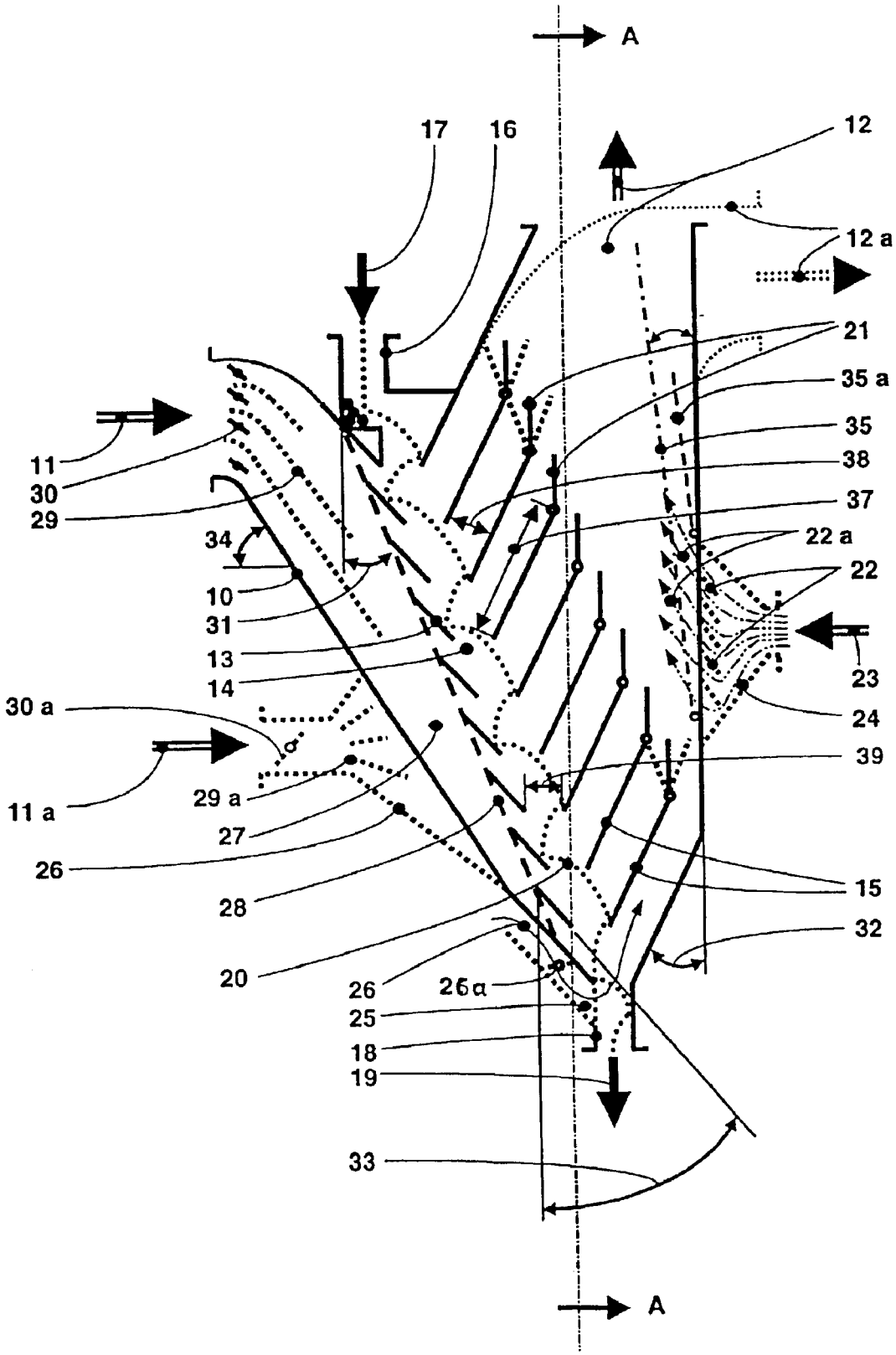
FIG. 1 is a static cascade classifier or V-classifier according to the invention, shown in vertical section, with flow paths illustrated

Referring to FIG. 1, the classifier has a housing 10 with a left leg or housing part in the form of an intake duct 27 into which classifying air 11 flows in laterally from above, and from a right leg or housing part of which a fines-laden classifying air 12 flows upwardly or at another arbitrary angle, for example 12*a*. The fines-laden classifying air is extracted via a fines collector by an induced-draft fan. It is also, however, possible to deliver fines-laden classifying air 12 directly to a reclassifier, which can be a static classifier or a dynamic classifier. Other drying gas can be used as a classifying gas in place of the classifying air 11 in case a moist classification feed is to be dried.

Built obliquely into housing 10 is a stairway cascade 13 permeable to classifying air 11, which cascade lies at an angle 31 departing from the vertical, which angle can lie in a range from 5° to 45°. Classifying flues 15 lying one above another in louver fashion, ascending obliquely upwardly and forming the other leg of the V, are built into the classifier housing 10 in parallel louver fashion approximately opposite the stairway cascade 13. The stairway cascade 13 and the classifying flues are separated by a crossflow classifying zone 14. The inclination angle 32 of the classifying flues 15 relative to the vertical being in a range from 0° to 35°. An inlet opening 16 for a classification feed 17 is arranged above the crossflow classifying zone 14 on the top of the housing, and a discharge opening 18 for an oversize fraction 19 freed of fines is arranged below the classifying zone 14 at the bottom of the housing.

The material 17 to be classified is fed to the classifier and falls by gravity downwardly in cascade fashion over the several steps of stairway cascade 13 and the classifying air 11 flows approximately in crossflow through the steps. The inclination angle 33 of the several steps of the cascade stairway 13 relative to the vertical is set in the range from 20° to 60° according to the angle of flow of the feed material. This classifying air flow tears the fines out of the cascade curtain of the descending material and transports it upwardly via the obliquely upwardly ascending classifying ducts between classifying flues 15 to a discharge for the fines-laden classifying air 12. In the classifying ducts between the classifying flues 15, entrained oversize particles slide back into the classifying zone 14 according to the principle of "gravity force against air flow drag force" or according to the principle of upward-current classification, and such oversize particles then have the opportunity to be further disintegrated and classified on their further path downwardly through the classifier. One path of an oversize particle downwardly through classifying zone 14 is shown schematically by a dashed line as an exemplary flow path 20.

Upwardly extending guide vanes 21 are pivotably articulated at the tops or upper ends of the classifying flues 15, which guide vanes are jointly or severally individually adjustable for the control of the classifying air velocity in the several classifying ducts lying between the classifying flues 15. This serves to equalize the classifying air velocity in the several classifying ducts and thus also to improve the selectivity of classification. By altering the outlet velocity of the classifying air 11 by setting the guide vanes 21 more or less steeply, the size of the classification feed particle still carried along by the outflowing classifying air 11 can be selectively influenced and thus, aside from the high separative efficiency, the cut point of the classifier according to the invention can also be selectively influenced.

According to a further feature of the invention, the classifier housing 10 can be provided, in the downstream region after the classifying flues 15 and the guide vanes 21, with inlet openings 22, in louver form as appropriate, for the introduction of a secondary air 23 as lifting air for the reliable lifting of the fines fraction upwardly out of the classifier. The louver slats of these inlet openings 22 can be designed fixed or adjustable, and then can be enclosed by an inlet box 24 for the secondary air 23. The cut point of the classifier can be expanded in the direction toward finer particle sizes with the aid of the secondary air 23.

The classifier housing 10 can have, somewhat above the discharge opening 18 for the oversize fraction 19, an inlet opening 25 for purge air 26 for reclassifying the oversize fraction and aiding the transport of the fines fraction out of the classifier. The volume flow rate of this purge air 26 can be adjusted with a throttle device 26*a*. The introduction of purge air 26 remedies the effect occasioned by the introduction of secondary air 23, which may, as appropriate, hinder the outlet of the classifying air from the lowermost classifying ducts arranged between the classifying flues 15.

According to a further feature of the invention, a louver partition 28 or a perforated-plate partition, having elements adjustable in louver fashion or having interchangeable perforated plates, can be arranged in the classifying gas intake duct 27 in front of stairway cascade 13, so that the clear cross section for the passage of classifying air can be adjusted individually for every step of the stairway cascade 13 as well as for every classifying flue 15. In addition, appropriately curved classifying gas guide vanes 29 influencing the classifying gas flow, having throttle devices 30, can be built into the classifying gas intake duct 27 of the classifier housing for the purpose of uniformly distributing classifying air/classifying gas 11 onto the stairway cascade, whereby the separative efficiency of the classifier is likewise increased. The position and number of the inlet openings can vary according to need; see 11*a*, 22*a*, as well as throttle device 30*a* and classifying gas guide vanes 29*a*.

In order that various requirements on the fineness of the classification feed can be met, at least one lateral wall of the classifier housing, the rear end wall 35 or 35*a* placed in the downstream region of the fines outlet 12, can be pivoted to adjust the very fine cut point and the associated flow velocity to the minimum value necessary for the withdrawal of the fines fraction. This permits a very fine cut point and low throughput for the withdrawal of the classifying air.

An inclination angle 34, measured to the horizontal, of a lower boundary wall of the classifying gas inlet duct 27 is larger than the natural angle of repose of the classification feed, and it is at least 50°. In principle, the inlet opening for classifying air or primary air 11 or 11*a*, respectively, can be arranged at an arbitrary height of the classifier and can be of single or multiple design.

In particular, if the material 17 to be classified contains press scales of material that come from a high-pressure roll mill or roll press for autogenous size reduction, the classifier will serve as a deagglomerator for the press scales, and the vertical distance between classification feed inlet opening 16 and discharge opening 18 for oversize fraction 19 should be at least approximately 4 meters.

The number of stationary parallel classifying flues 15 is governed by the maximum particle size of the fines and the size of the classifier, and as a rule the spacing 38 of the classifying flues should not exceed 600 mm and should not be less than 100 mm. The length 37 of classifying flues 15 should be at least 3.5 times the spacing 38 between the classifying flues 15. The maximum grain size of the feed material determines the clearance 39 between the cascade stairway 13 and the classifying flues 15. This clearance is at least equal to the spacing 38 of the classifying flues.

Figure 2:
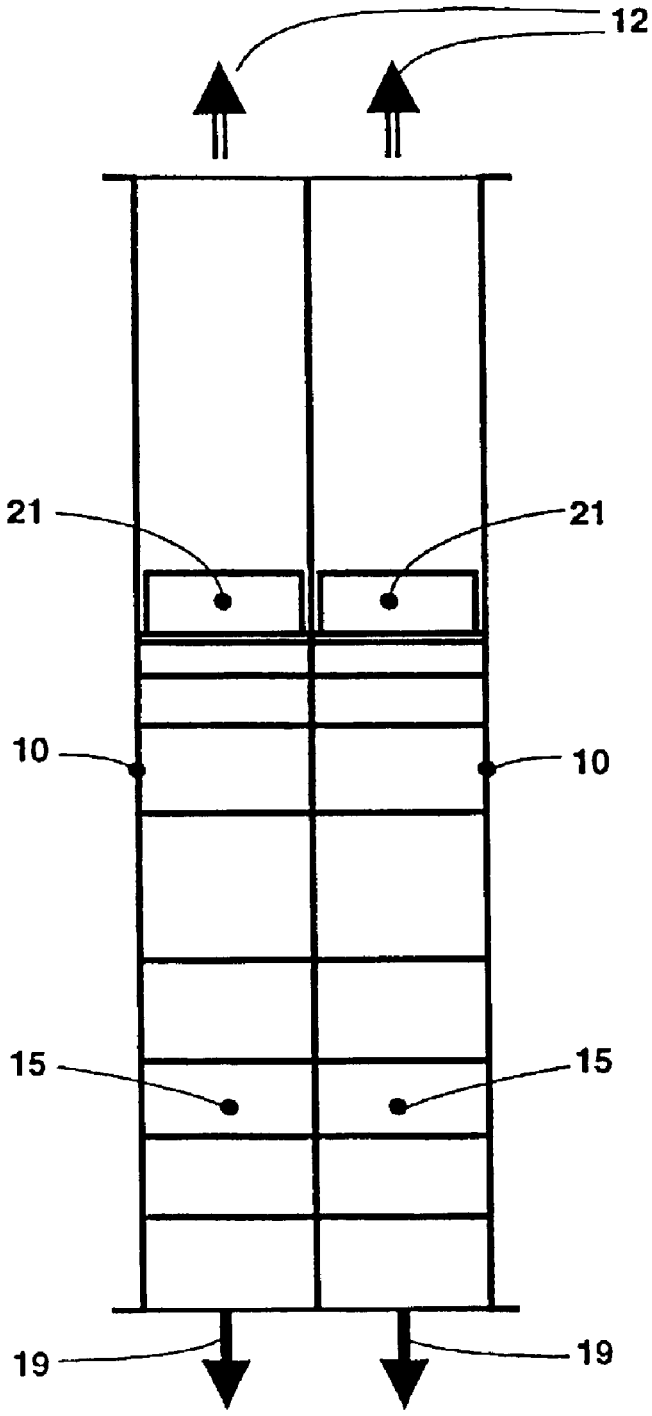
FIG. 2 is a vertical section taken on along the line A—A in FIG. 1.

FIG. 2 shows, that the classifier can be double-flued with two mirror-image halves. The classifier can, however, also have more than two flues.

What is claimed is:

1. A classifier for the classification of granular material comprising:

a classifier housing having a V-shape in vertical section with first and second legs and including a stairway cascade in said first leg, said stairway cascade lying obliquely at an angle departing from the vertical and said stairway cascade being permeable for passage for classifying gas there through, a classifying gas intake duct in said first leg directing classifying gas to said stairway cascade including a louver partition in upstream relation to said stairway cascade, and classifying flues lying one above the other and obliquely downwardly inclined in louver fashion in said second leg, said classifying flues defining classifying ducts there between and being positioned to define a classifying zone between said stairway cascade and said classifying flues, a feed inlet opening for a classification feed on the top of said housing and above said classifying zone, an oversize fraction discharge opening on the bottom of said housing below said classifying zone for the discharge of an oversize fraction of said granular material and upwardly extending guide vanes at the upper end of said classifying flues, said guide vanes being adjustable to control the velocity of said classifying gas passing through said classifying ducts.

2. The classifier as set forth in claim 1 wherein said guide vanes are pivotably articulated on the tops of said classifying flues.

3. The classifier as set forth in claim 1 having curved classifying gas guide vanes in said classifying gas intake duct for uniformly distributing the classifying gas onto the stairway cascade.

4. The classifier as set forth in claim 1 wherein said classifier housing includes a pivotable lateral wall downstream of said classifying flues and said guide vanes for altering the throughput of said classifying gas and the cut point of said classifier.

5. The classifier as set forth in claim 1 wherein the inclination of said stairway cascade to the vertical lies in a range from 50° to 45° and the inclination of said classifying flues to the vertical lies in a range from 0° to 35°.

6. The classifier as set forth in claim 1 wherein the vertical distance between said feed inlet opening and said discharge opening for said oversize fraction is at least 4 meters.

7. A classifier for the classification of granular material comprising:

a classifier housing having a V-shape in vertical section with first and second legs and including a stairway cascade in said first leg, said stairway cascade lying obliquely at an angle departing from the vertical and said stairway cascade being permeable for passage for classifying gas there through, a classifying gas intake duct in said first leg directing classifying gas to said stairway cascade classifying flues lying one above the other and obliquely downwardly inclined in louver fashion in said second leg, said classifying flues defining classifying ducts there between and being positioned to define a classifying zone between said stairway cascade and said classifying flues, and a pivotable lateral wall downstream of said classifying flues and said guide vanes for altering the throughput of said classifying gas and the cut point of said classifier, a feed inlet opening for a classification feed on the top of said housing and above said classifying zone, an oversize fraction discharge opening on the bottom of said housing below said classifying zone for the discharge of an oversize fraction of said granular material and upwardly extending guide vanes at the upper end of said classifying flues, said guide vanes being adjustable to control the velocity of said classifying gas passing through said classifying ducts.

8. The classifier as set forth in claim 7 wherein said guide vanes are pivotably articulated on the tops of said classifying flues.

9. The classifier as set forth in claim 7 wherein the inclination of said stairway cascade to the vertical lies in a range from 5° to 45° and the inclination of said classifying flues to the vertical lies in a range from 0° to 35°.

10. The classifier as set forth in claim 7 wherein the vertical distance between said feed inlet opening and said discharge opening for said oversize fraction is at least 4 meters.

11. A classifier for the classification of granular material comprising:

a classifier housing having a V-shape in vertical section with first and second legs and including a stairway cascade in said first leg, said stairway cascade lying obliquely at an angle departing from the vertical and said stairway cascade being permeable for passage for classifying gas there through, a classifying gas intake duct in said first leg directing classifying gas to said stairway cascade and classifying flues lying one above the other and obliquely downwardly inclined in louver fashion in said second leg, said classifying flues defining classifying ducts there between and being positioned to define a classifying zone between said stairway cascade and said classifying flues, a feed inlet opening for a classification feed on the top of said housing and above said classifying zone, an oversize fraction discharge opening on the bottom of said housing below said classifying zone for the discharge of an oversize fraction of said granular material and upwardly extending guide vanes at the upper end of said classifying flues, said guide vanes being adjustable to control the velocity of said classifying gas passing through said classifying ducts, said lower portion of said second leg of said V-shaped classifier housing having inlet openings and louver slats for the introduction of secondary air as lifting air for lifting out a fines fraction of said granular material.

12. The classifier as set forth in claim 11 wherein said guide vanes are pivotably articulated on the tops of said classifying flues.

13. The classifier as set forth in claim 11 wherein said classifier housing includes an inlet opening above said discharge opening for said oversize fraction, said inlet opening being provided for the admission of purge air for reclassifying said oversize fraction and aiding the transport of said fines fraction out of said classifier.

14. The classifier as set forth in claim 11 having a perforated-plate partition in said classifying gas intake duct in upstream relation to said stairway cascade.

15. The classifier as set forth in claim 11 having a louver partition in said classifying gas intake duct in upstream relation to said stairway cascade.

16. The classifier as set forth in claim 11 having curved classifying gas guide vanes in said classifying gas intake duct for uniformly distributing the classifying gas onto said stairway cascade.

17. The classifier as set forth in claim 11 wherein said classifier housing includes a pivotable lateral wall downstream of said classifying flues and said guide vanes for altering the throughput of said classifying gas and the cut point of said classifier.

18. The classifier as set forth in claim 11 wherein the inclination of said stairway cascade to the vertical lies in a range from 5° to 45° and the inclination of said classifying flues to the vertical lies in a range from 0° to 35°.

19. The classifier as set forth in claim 11 wherein the vertical distance between said feed inlet opening and said discharge opening for said oversize fraction is at least 4meters.

20. A classifier for the classification of granular material comprising:

a classifier housing having a V-shape in vertical section with first and second legs and including a stairway cascade in said first leg, said stairway cascade lying obliquely at an angle departing from the vertical and said stairway cascade being permeable for passage for classifying gas there through, a classifying gas intake duct in said first leg directing classifying gas to said stairway cascade and classifying flues lying one above the other and obliquely downwardly inclined in louver fashion in said second leg, said classifying flues defining classifying ducts there between and being positioned to define a classifying zone between said stairway cascade and said classifying flues, a feed inlet opening for a classification feed on the top of said housing and above said classifying zone, an oversize fraction discharge opening on the bottom of said housing below said classifying zone for the discharge of an oversize fraction of said granular material, upwardly extending guide vanes at the upper end of said classifying flues, said guide vanes being adjustable to control the velocity of said classifying gas passing through said classifying ducts, and an inlet opening in said classifier housing above said discharge opening for said oversize fraction, said inlet opening being provided for the admission of purge air for reclassifying said oversize fraction and aiding the transport of said fines fraction out of said classifier.

21. The classifier as set forth in claim 20 wherein said guide vanes are pivotably articulated on the tops of said classifying flues.

22. The classifier as set forth in claim 20 having a perforated-plate partition in said classifying gas intake duct in upstream relation to said stairway cascade.

23. The classifier as set forth in claim 20 having a louver partition in said classifying gas intake duct in upstream relation to said stairway cascade.

24. The classifier as set forth in claim 20 having curved classifying gas guide vanes in said classifying gas intake duct for uniformly distributing the classifying gas onto said stairway cascade.

25. The classifier as set forth in claim 20 wherein said classifier housing includes a pivotable lateral wall downstream of said classifying flues and said guide vanes for altering the throughput of said classifying gas and the cut point of said classifier.

26. The classifier as set forth in claim 20 wherein the inclination of said stairway cascade to the vertical lies in a range from 5° to 45° and the inclination of said classifying flues to the vertical lies in a range from 0° to 35°.

27. The classifier as set forth in claim 20 wherein the vertical distance between said feed inlet opening and said discharge opening for said oversize fraction is at least 4 meters.

28. A classifier for the classification of granular material comprising:

a classifier housing having a V-shape in vertical section with first and second legs and including a stairway cascade in said first leg, said stairway cascade lying obliquely at an angle departing from the vertical and said stairway cascade being permeable for passage for classifying gas there through, a classifying gas intake duct in said first leg directing classifying gas to said stairway cascade and classifying flues lying one above the other and obliquely downwardly inclined in louver fashion in said second leg, said classifying flues defining classifying ducts there between and being positioned to define a classifying zone between said stairway cascade and said classifying flues, a feed inlet opening for a classification feed on the top of said housing and above said classifying zone, an oversize fraction discharge opening on the bottom of said housing below said classifying zone for the discharge of an oversize fraction of said granular material, upwardly extending guide vanes at the upper end of said classifying flues, said guide vanes being adjustable to control the velocity of said classifying gas passing through said classifying ducts, and a perforated-plate partition in said classifying gas intake duct in upstream relation to said stairway cascade.

29. The classifier as set forth in claim 28 wherein said guide vanes are pivotably articulated on the tops of said classifying flues.

30. The classifier as set forth in claim 28 having a louver partition in said classifying gas intake duct in upstream relation to said stairway cascade.

31. The classifier as set forth in claim 28 having curved classifying gas guide vanes in said classifying gas intake duct for uniformly distributing the classifying gas onto the stairway cascade.

32. The classifier as set forth in claim 28 wherein said classifier housing includes a pivotable lateral wall downstream of said classifying flues and said guide vanes for altering the throughput of said classifying gas and the cut point of said classifier.

33. The classifier as set forth in claim wherein the inclination of said stairway cascade to the vertical lies in a range from 5° to 45° and the inclination of said classifying flues to the vertical lies in a range from 0° to 35°.

34. The classifier as set forth in claim 28 wherein the vertical distance between said feed inlet opening and said discharge opening for said oversize fraction is at least 4 meters.

35. A classifier for the classification of granular material comprising:

a classifier housing having a V-shape in vertical section with first and second legs and including a stairway cascade in said first leg, said stairway cascade lying obliquely at an angle departing from the vertical and said stairway cascade being permeable for passage for classifying gas there through, a classifying gas intake duct in said first leg including curved classifying gas guide vanes directing and uniformly distributing classifying gas to said stairway cascade and classifying flues lying one above the other and obliquely downwardly inclined in louver fashion in said second leg, said classifying flues defining classifying ducts there between and being positioned to define a classifying zone between said stairway cascade and said classifying flues, a feed inlet opening for a classification feed on the top of said housing and above said classifying zone, an oversize fraction discharge opening on the bottom of said housing below said classifying zone for the discharge of an oversize fraction of said granular material and upwardly extending guide vanes at the upper end of said classifying flues, said guide vanes being adjustable to control the velocity of said classifying gas passing through said classifying ducts.

36. The classifier as set forth in claim 35 wherein said guide vanes are pivotably articulated on the tops of said classifying flues.

37. The classifier as set forth in claim 35 wherein said classifier housing includes a pivotable lateral wall downstream of said classifying flues and said guide vanes for altering the throughput of said classifying gas and the cut point of said classifier.

38. The classifier as set forth in claim 35 wherein the inclination of said stairway cascade to the vertical lies in a range from 5° to 45° and the inclination of said classifying flues to the vertical lies in a range from 0° to 35°.

39. The classifier as set forth in claim 35 wherein the vertical distance between said feed inlet opening and said discharge opening for said oversize fraction is at least 4 meters.

40. A classifier for the classification of granular material comprising:

a classifier housing having a V-shape in vertical section with first and second legs and including a stairway cascade in said first leg, said stairway cascade lying obliquely at an angle departing from the vertical and said stairway cascade being permeable for passage for classifying gas there through, a classifying gas intake duct in said first leg directing classifying gas to said stairway cascade, a lower partition in said classifying gas intake duct in upstream relation to said stairway cascade, and stationary parallel classifying flues in said second leg lying one above the other and extending in an obliquely downwardly inclined louver fashion in said second leg, said flues having a length at least 3.5 times the spacing between said flues, and said classifying flues defining classifying ducts there between and being positioned to define a classifying zone between said stairway cascade and said classifying flues, a feed inlet opening for a classification feed on the top of said housing and above said classifying zone, an oversize fraction discharge openings on the bottom of said housing below said classifying zone for the discharge of an oversize fraction of said granular material and upwardly extending guide vanes at the upper end of said classifying flues, said guide vanes being adjustable to control the velocity of said classifying gas passing through said classifying ducts.

41. The classifier as set forth in claim 40 wherein said classifier housing includes a pivotable lateral wall downstream of said classifying flues and said guide vanes for altering the throughput of said classifying gas and the cut point of said classifier.

42. A classifier for the classification of granular material comprising:

a classifier housing having a V-shape in vertical section with first and second legs and including a stairway cascade in said first leg, said stairway cascade lying obliquely at an angle departing from the vertical and said stairway cascade being permeable for passage for classifying gas there through, a classifying gas intake duct in said first leg directing classifying gas to said stairway cascade, and stationary parallel classifying flues in said second leg lying one above the other and extending in an obliquely downwardly inclined louver fashion in said second leg, said flues having a length at least 3.5 times the spacing between said flues, and said classifying flues defining classifying ducts there between and being positioned to define a classifying zone between said stairway cascade and said classifying flues, a feed inlet opening for a classification feed on the top of said housing and above said classifying zone, an oversize fraction discharge openings on the bottom of said housing below said classifying zone for the discharge of an oversize fraction of said granular material and upwardly extending guide vanes at the upper end of said classifying flues, said guide vanes being adjustable to control the velocity of said classifying gas passing through said classifying ducts, and a pivotable lateral wall downstream of said classifying flues and said guide vanes for altering the throughput of said classifying gas and the cut point of said classifier.

* * * * *